United States Patent [19]

Peterson

[11] 4,388,971

[45] Jun. 21, 1983

[54] HANGER AND RUNNING TOOL APPARATUS AND METHOD

[75] Inventor: Elmer R. Peterson, Wilmington, Calif.

[73] Assignee: Baker International Corporation, Orange, Calif.

[21] Appl. No.: 307,906

[22] Filed: Oct. 2, 1981

[51] Int. Cl.[3] ..... E21B 23/06

[52] U.S. Cl. ..... 166/387; 166/124; 166/382

[58] Field of Search ..... 166/387, 378, 382, 123, 166/124, 125, 181, 182

[56] References Cited

U.S. PATENT DOCUMENTS

| | | | |
|---|---|---|---|
| 3,382,927 | 5/1968 | Davis, Jr. | 166/124 |
| 3,887,006 | 6/1975 | Pitts | 166/124 |
| 4,349,071 | 9/1982 | Fish | 166/124 |

*Primary Examiner*—Ernest R. Purser
*Assistant Examiner*—Thuy M. Bui
*Attorney, Agent, or Firm*—William C. Norvell, Jr.

[57] ABSTRACT

A conduit gripping tool such as a packer or hanger is provided for use in subterranean wells, together with a running tool and a method for installing the gripping tool in the well. Threaded means are mounted on the running tool for axial movement. The hand of such threads is in the opposite direction to the hand of the threaded connections of the work string supporting the running tool. The running tool additionally incorporates dogs which are engagable with slots provided in the gripping tool. A slip mechanism is retained against radial expansion during run-in. The dogs carried by the running tool are aligned with the slots in the hanger body for release so that torque in the same direction as the hand of the threaded connections of the work string is transmitted directly to the body of the hanger. Subsequently, an axially downward force applied by the work string will effect the setting of the slips and the concurrent disengagement of the dogs of the running tool from the body portion of the hanger. A further rotation of the work string in the same direction of the hand of the work string threaded connections will produce an unthreading of the nut carried by the running tool from the hanger body.

22 Claims, 11 Drawing Figures

HANGER AND RUNNING TOOL APPARATUS AND METHOD

BACKGROUND OF THE INVENTION

1. Field of the Invention:

This invention relates to an improved conduit gripping tool, such as a packer or hanger, for use in subterranean wells, and a running tool and method for installing the hanger in the well.

2. Description of the Prior Art:

In the completion or workover of any subterranean oil or gas well, it may be necessary to install one or more packers or hangers to accomplish various well known operations that are required for the completion of the well. For example, a hanger is generally mounted at a position immediately above a production formation to permit the installation of a screen and the subsequent gravel packing of such screen and adjacent portions of the production formation. Packers and/or bridge plugs are also required to be set in gripping engagement with the casing at various points along the casing bore.

All conventional packers and hangers which are mechanically set in gripping engagement with the casing have heretofore required two successive or sequential rotational movements in opposite directions, one of which is the same direction as the hand of the threaded connections of the tubular work string by which the packer or hanger is inserted and installed in the well, and the other rotation is in the reverse direction. One of such rotations is required to effect the release of the hanger or packer setting mechanism preliminary to the application of a downwardly directed setting force to the packer or hanger. The second rotational movement is normally required to effect the release of the running tool from the packer or hanger after setting is accomplished, so that the running tool and work string may be withdrawn from the well.

The primary reason that the prior art mechanisms for initiating setting of the casing gripping tool and the subsequent release of the running tool therefrom required two opposite rotations of work string, is that the known hanger or packer mechanisms were incapable of distinguishing between the rotational movements applied thereto to confine the effects thereof to merely the preliminary setting operation or the subsequent releasing operation of the running tool. It has therefore become the standard practice to employ a left hand rotation of the work string and running tool to initiate the setting of the hanger or packer, and then use a right hand rotation of the work string and running tool to effect the release of the running tool from the packer or hanger after the setting thereof. Obviously, anytime that a left hand rotation is applied to a right hand threaded tubular work string, there is the danger that the unthreading of one of the multitude of pipe sections will occur, rather than the transmission of the rotational force to the running tool located at the bottom of the threadably interconnected work string.

It therefore becomes highly desirable that both the setting initiation rotation of the running tool and the releasing rotation of the running tool be in the same direction, and that this direction be the same as the hand of the threaded connections of the tubular work string. In other words, in the ordinary situation, where right hand threads are used to make up the tubular work string, two sequential right hand rotations of the work string and running tool are preferred to effect the release of the packer or hanger for setting and the subsequent release of the running tool from the packer or hanger.

SUMMARY OF THE INVENTION

This invention provides a mechanical setting mechanism for a conduit gripping tool, such as a hanger or packer and a running tool for such element which permits the initiation of the setting of the conduit gripping tool by a right hand rotation, followed by the application of a downward force to the conduit gripping tool to set same and then a second right hand rotation of the work string and running tool will effect the release of the running tool from the casing gripping tool.

The conduit gripping tool embodying this invention, such as a hanger, packer or bridge plug, includes a tubular body portion which is mounted in surrounding relationship to a running tool secured to the bottom end of a tubular work string. A threaded connection is provided between the tubular work string and the top end of the conduit gripping tool, and the threads of such connection are of opposite hand to the threaded connections of the work string. Thus, after setting of the conduit gripping tool in the well, a rotation of the work string in the direction to tighten the threads thereof will effect the release of the running tool from the conduit gripping tool.

To effect the setting of the conduit gripping tool, a plurality of annular segment slips are provided in surrounding relationship to the body portion of the conduit gripping tool. Such slips are secured by a plurality of peripherally spaced, bowed leaf springs to a ring which is slidably mounted on the body portion of the gripping tool. The leaf springs maintain a frictional engagement with the bore of the casing during the insertion and the setting operation. An annular cone element for effecting the radially outward camming of the annular segment slips is mounted in surrounding relationship to the body portion of the conduit gripping tool, but relative axial displacement of the cone element with respect to the slip elements is prevented, during the insertion of the conduit gripping tool, by a plurality of shear pins. Additionally, the application of any axial force to such shear pins is prevented through the cooperation of a radially projecting pin carried by the tubular body portion of the conduit gripping tool, with an inverted L-shaped slot provided in the ring member which is secured to the annular segment slips by the aforementioned leaf springs. Thus, the annular segment slip elements of the conduit gripping tool are maintained in a radially retracted position while the conduit gripping tool is inserted in the well on the running tool.

When the conduit gripping tool is positioned at its desired location, the work string and running tool are elevated a short distance with respect to the conduit gripping tool and this relative axial displacement permits a plurality of radially disposed, spring biased dogs carried by the running tool to snap into engagement with cooperating internal grooves formed in the bore of the tubular body of the conduit gripping tool. Thus, the conduit gripping tool is effectively locked to the body of the running tool for corotation, and hence rotation of the running tool in a right hand direction has no effect on the left handed threaded connection between the running tool and the conduit gripping tool. Such rotation does, however, effect the release of the radially projecting pin carried by the tubular body portion of the running tool from the inverted L-shaped slot carried by the spring mounting ring of the segmented slip elements and, thereafter, the body portion of the running tool may be moved axially downwardly with respect to the segmented annular slip elements, thus permitting the annular cone carried by the tubular body portion to effect an outward expansion of the annular segment slip elements into gripping engagement with the casing wall. Concurrently, the downward movement of the body portion of the conduit gripping tool is employed to effect the compression and radial expansion of an annular elastomeric mass to the achieve a sealing engagement with the casing bore.

Additionally, an annular locking member having a wickered thread engagement with similar threads provided on the exterior of the body portion of the conduit gripping tool prevents reverse axial movement of the body portion relative to the slips and the elastomeric seal, and locks the slips and elastomeric seal in their expanded positions, in tightly gripping, sealing engagement with the bore of the conduit.

The downward motion of the conduit gripping tool required to effect its setting is, of course, produced by the running tool but a lost motion connection is provided between the running tool and the conduit gripping tool so that the running tool first moves downwardly sufficient to cam the locking dogs inwardly out of engagement with the slots provided in the tubular body portion of the conduit gripping tool. Thus, after the conduit gripping tool has been set, the running tool is no longer connected to the casing tool for co-rotation and thus a rotation of the work string and the running tool in a right hand direction effects the release of the left hand threaded connection of the running tool to the top of the body portion of the conduit gripping tool. After such release, the running tool may be withdrawn from the well by the work string.

DESCRIPTION OF THE PREFERRED EMBODIMENTS

Figure 1A:
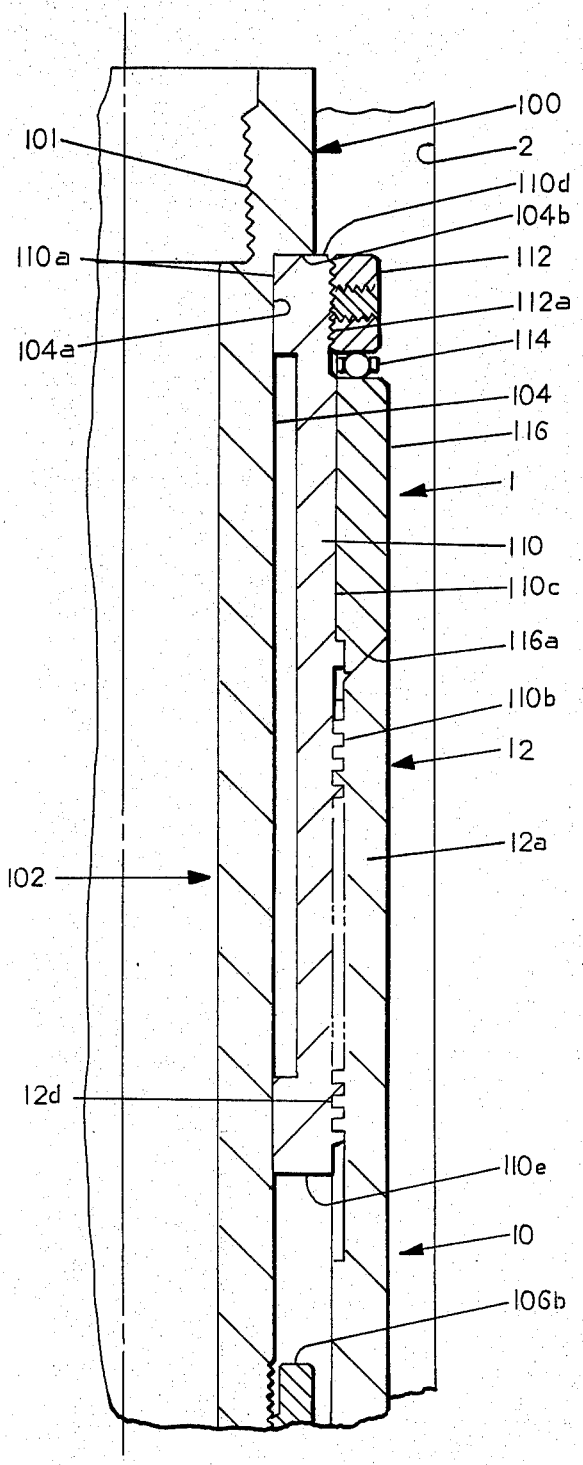
FIGS. 1A, 1B, 1C, 1D, and 1E together constitute a schematic vertical sectional view of a running tool and hanger embodying this invention with the elements thereof shown in the positions occupied during insertion into a well casing, FIGS. 1B, 1C, 1D and 1E being respectively vertical continuations of FIGS. 1A, 1B, 1C and 1D.

Referring to the drawings, a well completion apparatus 1 is illustrated comprising a conduit, or casing, gripping tool 10, which in the illustrated example is a hanger, and a running tool 100. Running tool 100 is provided at its upper end with internal threads 101 for connection of the bottom end of a work string (not shown). The hand of the threads 101 is in the same direction as the hand of the threaded connections of the work string and this is normally a right-handed thread.

Hanger 10 is disposed in generally surrounding relationship to the running tool 100 and comprises a tubular body portion 12. The tubular body 12 comprises two upper and lower sleeve portions **12*a* and 12*b* which are interconnected by threads 12*c*. The upper body portion 12*a* is provided with internal square threads 12*d* of a hand opposite to the hand of the work string threaded connections. In the normal instance, the threads 12*d* would be left-handed. The bottom of the lower body portion 12*b* is suitably connected to any conventional type of well completion apparatus 14 (FIG. 1E), such as a gravel packing or cementing apparatus. The construction of the apparatus is entirely conventional and hence further description is deemed unnecessary. Threads 13 interconnect the well completion apparatus 14 with the bottom end of the lower body portion 12*b***.

A plurality of peripherally spaced, annular segment slips 20 (FIGS. 1C and 2C) are mounted in surrounding relationship to the lower body section **12*b*. Slips 20 are provided with external teeth 20*a* which are contoured to effect a biting engagement with the wall of the well casing 2 to prevent downward relative movement of the slips with respect to the well casing when the slips are expanded radially outwardly into engagement therewith. Each slip 20 has a reduced thickness lower portion 20*b* which is mounted to the upper end of a leaf type support spring 22 by suitable bolts 21. The bottom ends of support springs 22 are in turn secured by suitable bolts 23 to an annular ring 24 which is disposed in surrounding, freely sliding relationship to the lower tubular portion 12*b***.

Figure 3:
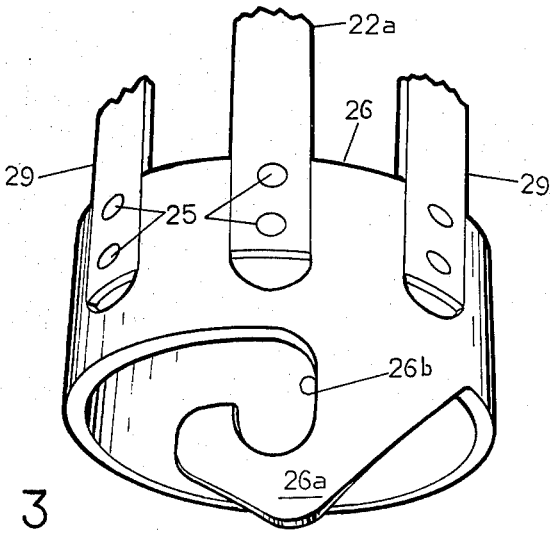
FIG. 3 is a perspective view of that portion of the hanger slip assembly defining an inverted L-shaped slot for connection with a radial pin formed on the hanger body.

Preferably, three support springs 22 are provided which are therefore disposed at a 120° angularly spaced relationship to each other. Support springs 22 have an integral depending extension **22*a* (FIGS. 1D, 1E, 2D and 2E) which is of outwardly bowed configuration so as to always frictionally engage the interior of the casing wall 2. The lower ends of support spring extensions 22*a* are secured to a second ring 26 by suitable bolts 25. Additionally, to increase the frictional engagement with the casing wall 2, three additional outwardly bowed leaf springs 29 are provided which have the ends thereof respectively secured to the first and second rings 24, 26 by appropriate bolts 25 (FIG. 3**).

The second or lower ring 26 is provided with a depending annular segment **26*a* which defines an inverted L-shaped slot 26*b*. Slot 26*b* receives a radially projecting pin 28 which is welded or otherwise rigidly secured in the wall of the lower tubular body section 12*b*. Pin 28 may comprise an outer sleeve 28*a* having its bore filled with weld 28*b*. The direction of the inverted L-shaped slot 26*b* is such that the pin 28 cannot be released from such slot until it is moved upwardly relative to the slot and then the hanger body portion 12*b* is rotated in the same direction as the hand of the threaded connections of the work string, which in the specific example herein illustrated, is in a right-hand direction. Thus, a combination of axial movement plus right-hand rotational movement of the tubular body 12 of the hanger 10 is required to effect the separation of the tubular body 12 from the slips 20**.

To effect the outward expansion of the annular segment slips 20 into gripping engagement with the casing wall 2, a conventional annular cone 30 (FIGS. 1C and 2C) is provided which is mounted in freely surrounding relationship on the lower tubular portion **12*b* of the hanger 10. Cone 30 is secured against axial displacement during run-in by one or more shear screws 31 which are radially disposed and threaded into appropriate holes provided in the lower tubular body section 12***b*. The bottom portion of the cone 30 is provided with a customary inclined conical segment surface 30*a* which engages a correspondingly shaped internal surface 20*c* provided on slips 20 to effect the radial outward expansion of the slips 20 by relative downward movement of the cones 30.

The upper portion of the annular cone 30 is provided with an annular recess 30*b* within which is mounted an annular locking ring 32 and a cooperating retaining ring 34. Locking ring 32 has internal wicker threads 32*a* which cooperate with correspondingly shaped threads formed on the exterior of the lower tubular body section 12*b*. The external surface of locking ring 32 is of conical configuration, as illustrated at 32*b*, and cooperates with a correspondingly shaped surface 34*b* formed on the retaining ring 34. The retaining ring 34 is threadably engaged in the upper end of the cone 30 by threads 30*c*.

An annular elastomeric sealing assembly 40 is provided immediately above the upper end of cone 30. Such sealing assembly comprises an annular mass of elastomeric material 41 which is confined at its upper and lower ends by lead rings 42 and 43 having radially inclined contacting surfaces 42*a* and 43*a* respectively engaging correspondingly shaped surfaces 41*a* and 41*b* formed on the elastomeric sealing mass 41.

Above the upper lead ring 42, a force transmitting ring 44 is provided, which in turn is internally threaded, as at 44*a*, to engage cooperating threads provided on the lower end of the upper tubular body portion 12*a*.

It is therefore apparent that when the pin and slot connection between the lower tubular body section 12*b* and the annular segment slips 20 is released to permit relative downward movement of hanger body 12 with respect to the slips, a downward axial force is applied through the force transmitting ring 44 to the upper lead ring 42, thence to the annular elastomeric sealing mass 41, then through the lower lead ring 43 to the upper end of the cone 30. As previously stated, downward axial movement of the cone 30 will produce an outward expansion of the slips 20 into gripping engagement with the casing wall 2. Lock ring 32 prevents reverse movement of the body 12 relative to slips 20.

To effect the run-in and setting of the conduit or casing gripping tool 10, this invention provides a unique running tool assembly 100. As previously mentioned, the running tool 100 is secured to a bottom of a work string (not shown) by internal threads 101 provided in the top portion of a tubular body assembly 102. Body assembly 102 includes a top "kelly" element 104, defining the connecting threads 101, and being threadably secured at its lower end to a main tubular body portion 106. Main body portion 106 in turn is threadably secured to a test mandrel 108 by threads 107. It should be stressed that devices connected by threads 107 to the body assembly 102 are completely conventional and form no part of the instant invention.

The "kelly" element 104 is of conventional tubular configuration, having longitudinally extending flat portion 104*a* formed in peripherally spaced relationship around its exterior. A connecting nut 110 is provided having an internal bore 110*a* contoured to conform to the flat surfaces 104*a* provided on the exterior of the "kelly" element 104 and being mounted on the "kelly" element 104 for limited relative axial movement determined by the spacing between the top surface 106*b* of the main tubular body portion 106 and the downwardly facing surface 104*b* provided on the "kelly" element 104.

The exterior of connecting nut 110 is provided with a square thread 110*b* having a hand opposite to that of the threaded connections of work string, hence in the normal instance, it is provided with left-hand square threads. These threads cooperate with the internal threads 12*d* provided on the tubular body 12 of the hanger 10 and effect a detachable connection of the running tool 100 to the hanger 10. In order to assure the rotation of the connecting nut 110 with respect to the tubular body 12 of the hanger 10 under axial loading, a force transmitting ring 112 is provided which is threadably secured to the upper end of the nut 110 by threads 112*a* and clamps an anti-friction bearing unit 114 between itself and the top surface of a connecting ring 116, which is slidably mounted on the cylindrical exterior portion 110*c* of the connecting nut 110 and has a downwardly facing surface 116*a* abutting the upwardly facing end surface of the upper tubular body portion 12*a* of the tubular body assembly 12. This assembly also serves the function of preventing excessive threaded interengagement of the connecting nut threads 110*b* with the internal threads 12*d* which would tend to produce a binding of such threads.

The medial portion of the main tubular body element 106 is provided with a plurality of radially outwardly biased dogs 118 which are mounted in peripherally spaced relationship around the main tubular body 106 in elongated slots 106*c* provided in the main tubular body portion 106. Each dog 118 is biased radially outwardly by a pair of compression springs 120. Each dog is retained in assembly with the main tubular body 106 by a pair of transverse pins 122 which pass through the tubular body 106 and through radially disposed slots 124 provided in each dog 118. Both the top and bottom outer surfaces of the dogs 118 are rounded as indicated at 118*a* and 118*b* so that such dogs may be cammed inwardly by axial movement engagement with internal shoulders 12*e* and 12*f* respectively provided at the top and bottom ends of an equal number of axial slots 12*g* formed in the lower portion of the upper body portion 12*a* of the hanger 10.

Figure 1B:
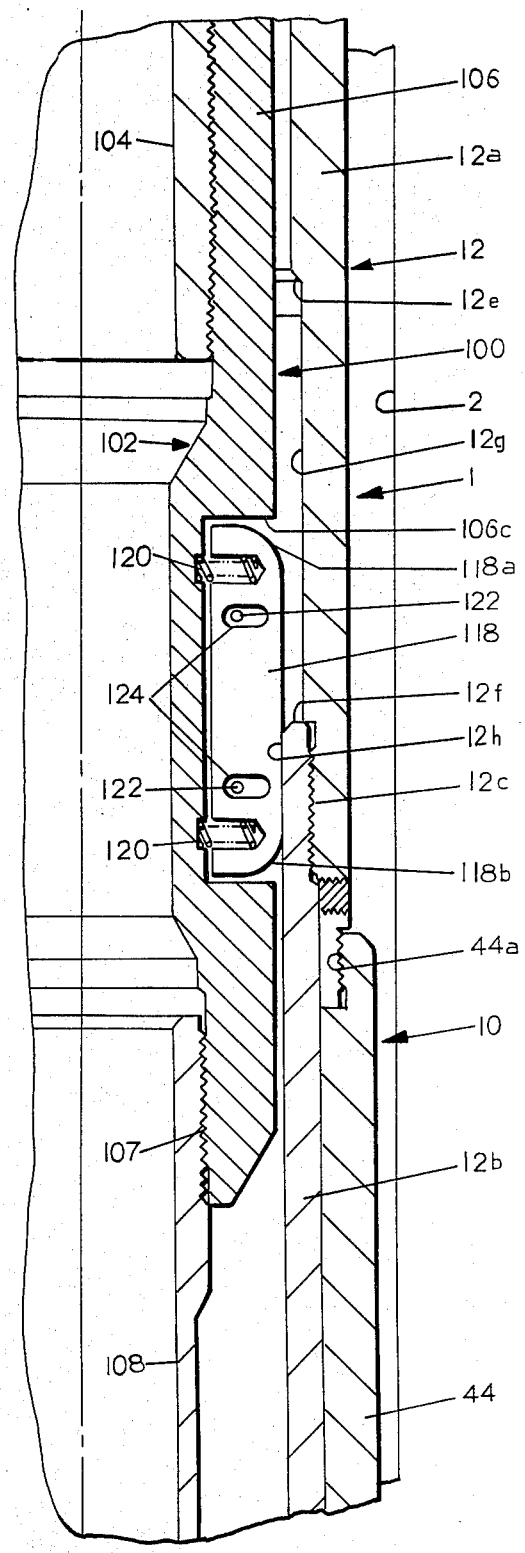
Figure 1C:
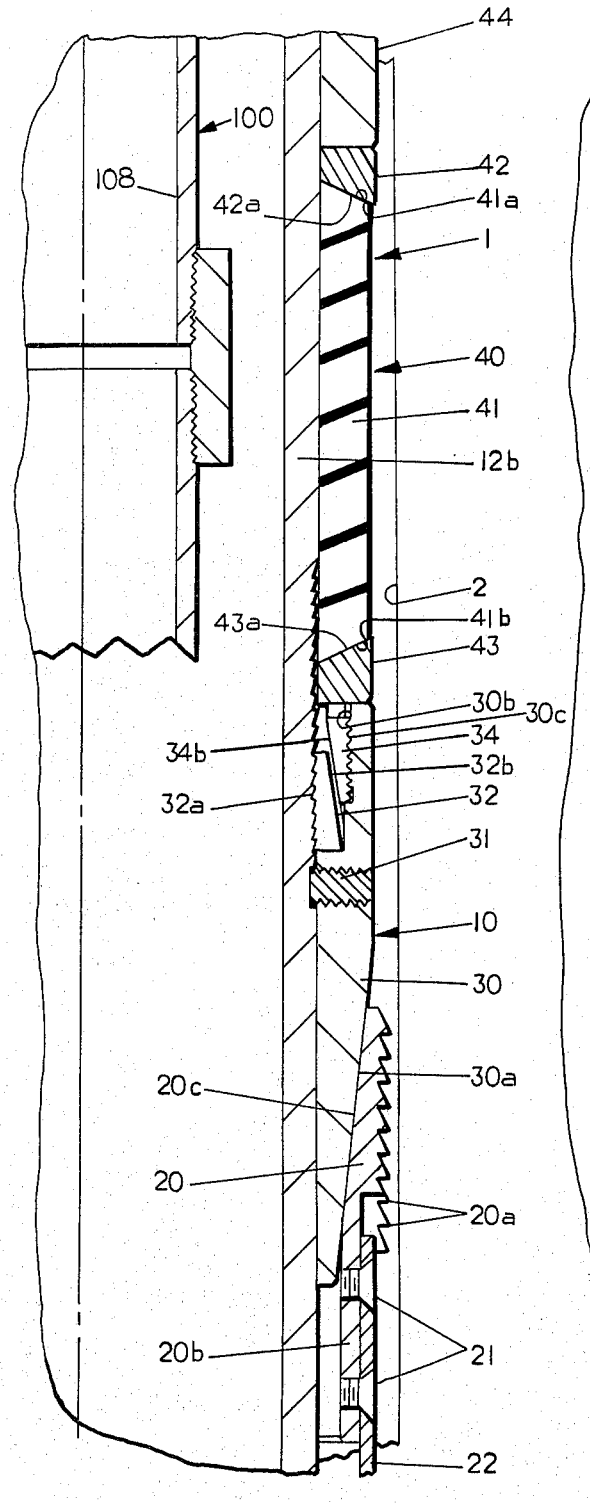
Figure 1D:
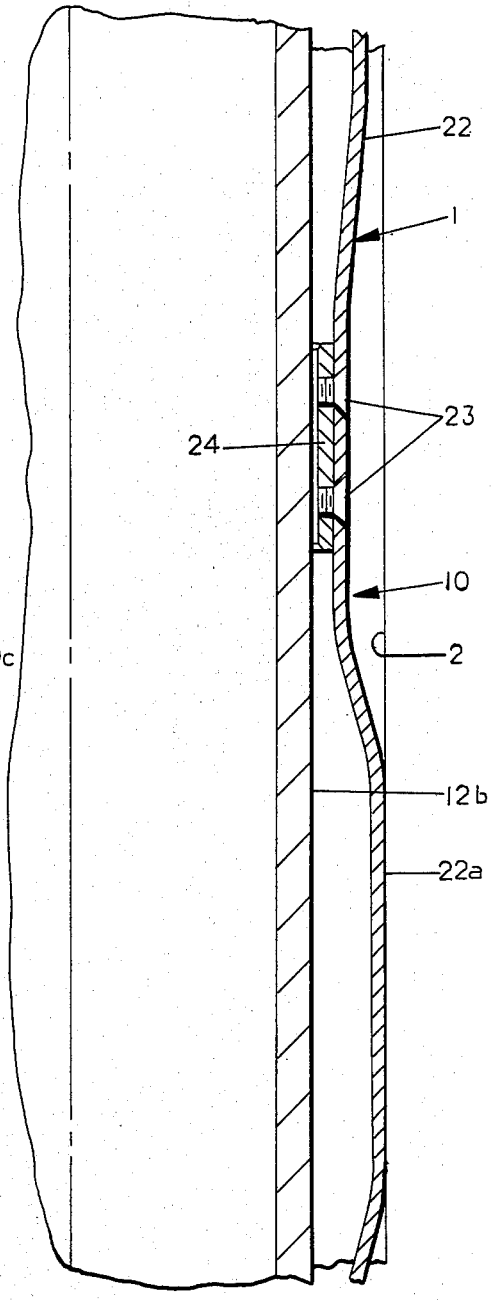
Figure 1E:
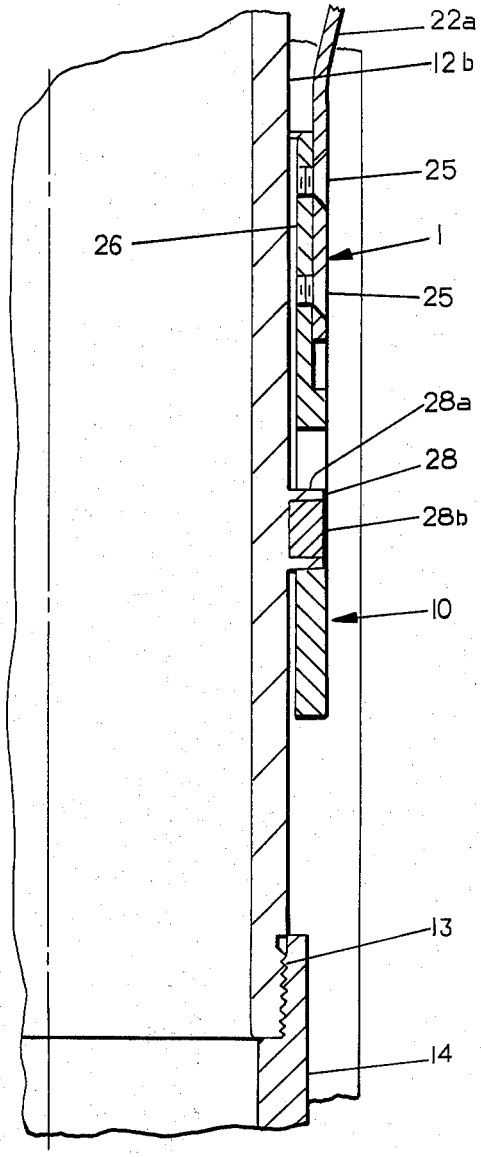
Figure 2E:
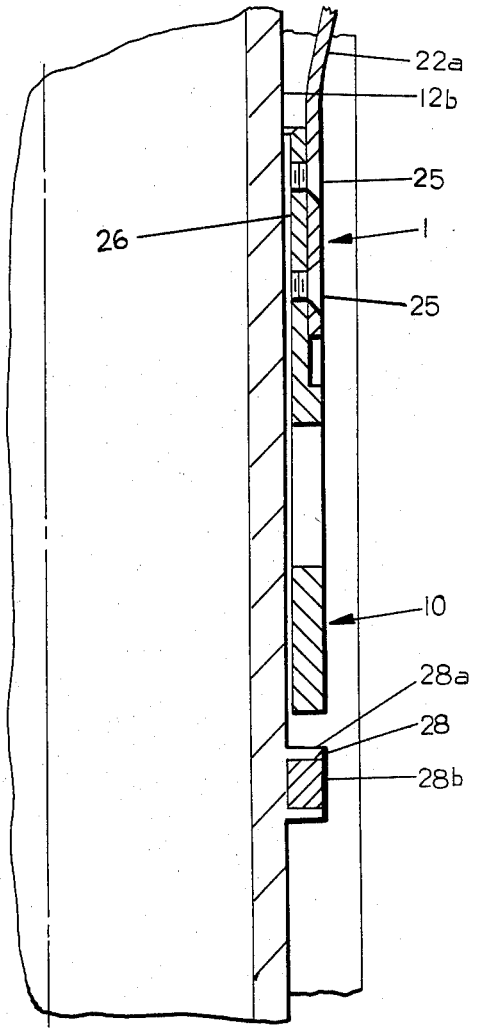
FIGS. 2C, 2D and 2E are views respectively similar to FIGS. 1C, 1D and 1E, but showing the elements of the hanger in their set position.

The extent of free movement of the running tool 100 with respect to hanger 10 is greater than the axial clearance between the dogs 118 and the annular recess 12*g*, so that when the downwardly facing surface 104*b* provided on the "kelly" element 104 is in contact with the upper end surface 110*d* of the connecting nut 110, the dogs 118 will be axially misaligned with the slots 12*g*, hence will be held in a retracted position as best shown in FIGS. 1A and 1B. However, when the dogs 118 are aligned with slots 12*g*, they provide an assured torque transmitting connection between the main body portion 106 of the running tool 100 and the upper tubular body portion 12*a* of the hanger 10 so that rotation of the work string in the same direction as the hand of the threaded connections of the work string will not produce any disengagement of the cooperating left-hand threads 110*b* and 12*d*.

OPERATION

Figure 2A:
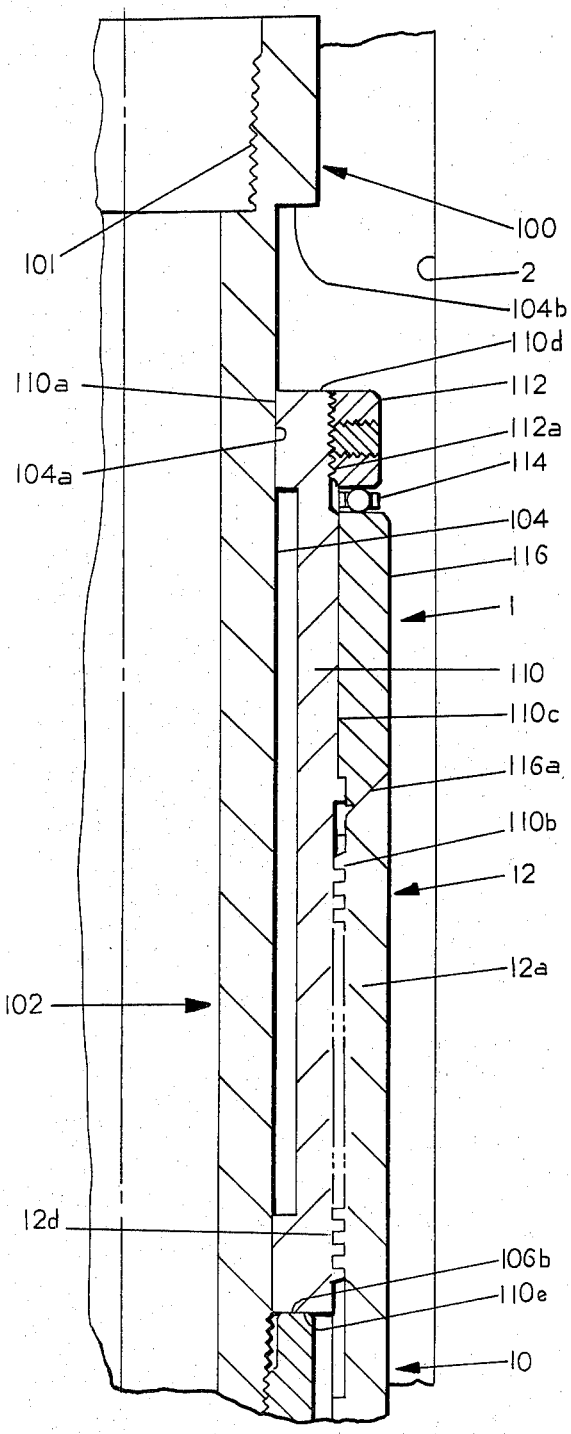
FIGS. 2A and 2B, are views similar respectively to FIGS. 1A and 1B, but showing the elements of the hanger and the running tool in the positions occupied during the release of the slip assemblies prior to setting of the hanger.
Figure 2B:
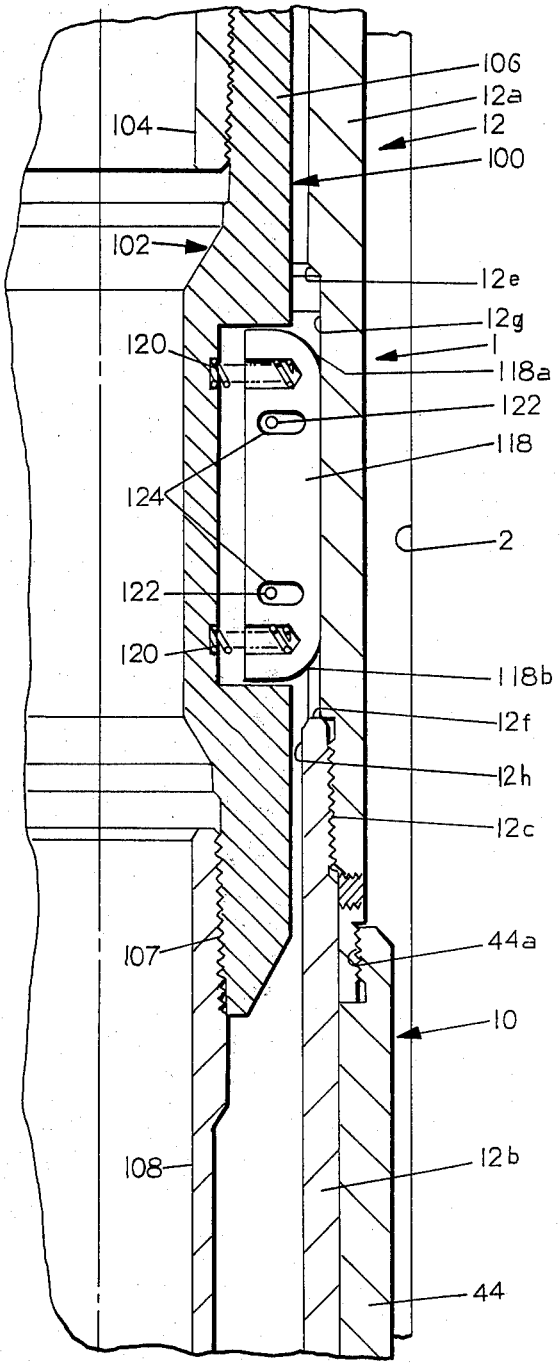
Figure 2C:
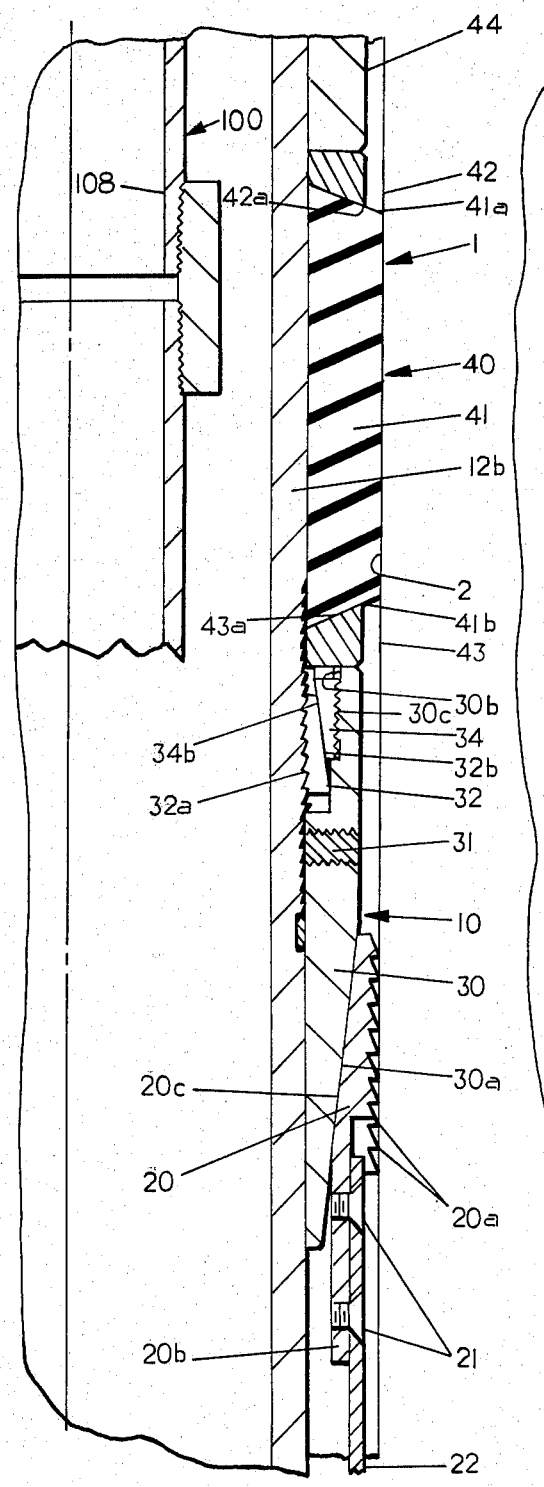
Figure 2D:
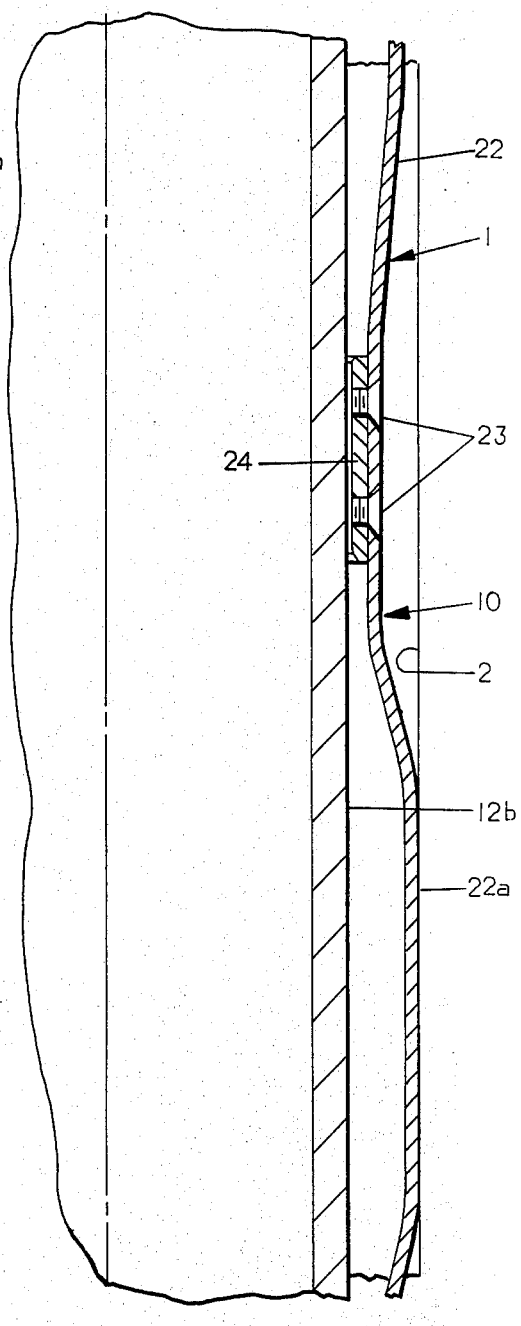

The running tool 100 is assembled with the hanger 10 in the manner indicated in FIGS. 2A and 2B and the assembly, including any auxiliary apparatus 14 suspended from the hanger 10, is inserted in the well on the end of a work string. The outwardly bowed leaf springs 22*a* and 29 will frictionally engage the inner wall of the casing 2. Such frictional engagement will cause the hanger 10 to move upwardly relative to the running tool 100 to the extent permitted by the spacing between the downwardly facing shoulder 104*b* provided on the running tool and the upper end surface 110*d* of the connecting nut 110. In this position the torque transmitting dogs 118 are cammed inwardly by the bore surface 12*h* of the lower hanger body section 12*b*. During the well insertion movement, the slips 20 are retained in their collapsed position by their support springs 22 and the cone 30 is prevented from any movement relative to the slips 20 by the shear bolts 31. Additionally, the radial pin 28 is engaged in the lower portion of the inverted L-shaped slot 26*b* in slip ring 24. Thus, no relative downward movement of the hanger body 12 with respect to the slips 20 can occur during the well insertion procedure.

The hanger 10 is first positioned slightly below the desired set position in the well casing 2. The running tool 100 is then elevated by the work string (not shown) so as to bring the locking dogs 118 into axial alignment with the axial recesses 12*g* in the upper tubular body portion 12*a*. At approximately the same position, the top end 106*b* of the main body portion 106 of running tool 100 is brought into abutment with the bottom surface 110*e* of the connecting nut 110. Thus, further upward movement of the running tool 100 effects an upward displacement of the hanger 10 so that the radial pin 28 moves upwardly into the top end of the inverted L-shaped slot 26*b* provided in the lower ring 26. At this point, the work string may be rotated in the same direction as the hand of the threaded connections of the work string, and this rotation will bring the radial pin 28 out of the horizontal open end of the inverted L-shaped slot 26*b*. During this rotation, the hanger body 12 is anchored to the running tool 10 by the cooperation of the locking dogs 118 with the recesses 12*g* in the upper section 12*a* of the hanger body 12. Thus, no unscrewing of the left hand threaded connection between the connecting nut 110 and the internal threads 12*b* of the tubular hanger body 12 will occur.

The work string, and hence the running tool 100, are then moved axially downwardly to set the hanger 10, and this motion is no longer limited by the slot 26*b*, so that downward movement of the cone 30 is produced relative to the slips 20. Such downward movement of cone 30 produces an outward displacement of the teeth 20*a* of slips 20 and they take an initial bite into the surface of the adjoining casing wall 2. As the axial downward force is continued to be applied, the downward force shears the shear screw 31 and the slips 20 are forced more securely into engagement with the casing wall 2 and concurrently the annular elastomeric seal mass 41 is compressed and forced radially outwardly into sealing engagement with the casing wall 2. The wicker threaded lock ring 32 is moved downwardly with such downward movement of the hanger body 12 and locks the axial compressing force into the assembly by preventing any return upward movement of the hanger body portion 12 with respect to the cone 30. The hanger 10 is thus set with the slip teeth 20*a* firmly engaged in the casing wall 2 and the annular elastomeric mass 41 sealingly engaging the casing wall 2.

The release of running tool 100 may now be accomplished by rotation of the work string in the same direction as the threaded connections of the work string or, in the particular example herein discussed, rotation in a right-hand direction. Such right-hand rotation will produce an unthreading of the connecting nut 110 from the internal threads 12*d* of the upper body section 12*a* of the tubular hanger body 12. The relative rotation of the running tool 100 with respect to hanger 10 is not prevented by the locking dogs 118 since they are positioned as illustrated in FIG. 1B vertically below the cooperating recess 12*g* in the upper body section 12*a* and hence no longer transmit torque from the running tool 100 to the hanger body 12.

The running tool 100 may then be elevated by the work string and withdrawn from its position within the hanger body 12. As the dogs 118 move upwardly, they may momentarily snap into the hanger body recesses 12*g* but the rounded upper ends 118*a* of the locking dogs 118 immediately cams the locking dogs inwardly to permit the unimpeded passage of the running tool 100 out of the bore of the hanger 10.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. The method of setting a conduit gripping tool by a running tool on a threadably connected work string, insertable within a subterranean well, comprising the steps of:

1. running the conduit gripping tool to a desired position in the well on the running tool;
2. rotating the running tool and a portion of the conduit gripping tool in the same direction as the hand of the work string threaded connections, thereby releasing the conduit gripping tool for setting;
3. applying an axial force to the conduit gripping tool to set same in gripping relation to the conduit; and
4. rotating the running tool relative to the entire conduit gripping tool in the same direction as the hand of the work string threaded connections to release the running tool from the conduit gripping tool.

2. The method of inserting a conduit gripping tool in a subterranean well conduit by a tubular work string and setting the tool into rigid engagement with the conduit wall, the conduit gripping tool being of the type that is released for setting by rotation of the body thereof in the same direction as the hand of the tubular work string threaded connections, and is set by an axial force imposed by the work string, comprising the steps of:

1. assembling a running tool to the end of a tubular work string for co-rotation therewith;
2. connecting the upper body portion of the conduit gripping tool to the lower end of the running string thread connections;
3. inserting the conduit gripping tool to a desired location in the conduit by insertion of the tubular work string while maintaining a frictional engagement of a portion of the conduit gripping tool with the conduit;
4. moving the running tool axially relative to the conduit gripping tool to establish a torque transmitting connection between the running tool and the conduit gripping tool;

5. rotating the work string in the same direction as the hand of the tubing string threaded connections to release the setting tool for setting;
6. setting the conduit gripping tool into fixed engagement with the conduit by an axial force applied by the work string and concurrently moving the running tool axially to disengage said torque transmitting connection; and
7. again rotating the work string in the same direction as the hand of the tubing string threaded connection to release the threaded connection between the running tool and the conduit gripping tool, thereby permitting removal of the tubular work string and running tool from the well.

3. The method of inserting a settable tool in a well conduit by a tubular work string having right hand threaded connections, and setting the tool at a selected position in the conduit, the settable tool being of the type that is released for setting by rotation of the body thereof in a right hand direction and is subsequently set by a downward force imposed by the work string, comprising the steps of:

1. assembling a running tool to the end of a tubular work string for co-rotation therewith;
2. connecting the upper body portion of the conduit gripping tool to the lower end of the running tool by left hand threads;
3. inserting the settable tool to a desired location in the casing by insertion of the tubular work string, while maintaining a frictional engagement of a portion of the settable tool with the conduit;
4. moving the running tool upwardly relative to the settable tool to establish a torque transmitting connection between the running tool and the settable tool;
5. rotating the work string in a right hand direction to release the settable tool for setting;
6. setting the settable tool by downward force applied by the work string and concurrently moving the running tool downwardly relative to the settable tool to disengage said torque transmitting connection; and
7. rotating the work string in a right hand direction to release the left hand threaded connection between the running tool and the settable tool, thereby permitting removal of the tubular work string and running tool from the well.

4. A running and setting tool insertable into a subterranean well and for a conduit gripping tool of the type that is released for setting by rotation of the body portion of the conduit gripping tool in the same direction as the hand of the work string threaded connections, comprising: a tubular body; means on the upper end of said tubular body for rigid connection to the end of a work string; an externally threaded sleeve slidably mounted on said tubular body for limited axial movement; the hand of said external threads being opposite to the hand of the work string threaded connections; said external threads being adapted to engage cooperating internal threads on the conduit gripping tool; means for securing said externally threaded sleeve for co-rotation with said tubular body in all relative axial positions, the lower portions of said tubular body being constructed and arranged to extend within the body portion of the conduit gripping tool; and means on said lower portions of said tubular body for effecting a torque transmitting connection to the body portion of the conduit gripping tool at one relative axial position of the running tool with respect to the conduit gripping tool.

5. A running and setting tool insertable into a subterranean well and for a conduit gripping tool of the type that is released for setting by rotation of the body portion of the conduit gripping tool in the same direction as the hand of the work string threaded connections, comprising: a tubular body; means on the upper end of said tubular body for rigid connection to the end of a work string; an externally threaded sleeve slidably mounted on said tubular body for limited axial movement; the hand of said external threads being opposite to the hand of the work string threaded connections; said external threads being adapted to engage cooperating internal threads on the conduit gripping tool; means operative between said tubular body portion and said externally threaded sleeve to secure same for rotational co-movement in all relative axial positions; and a plurality of peripherally spaced, radially outwardly biased dogs on the lower portions of said tubular body portion adapted to engage the body portion of the conduit gripping tool to transmit torque thereto at one vertical position of said running tool relative to the conduit gripping tool, whereby the conduit gripping tool may be released for setting by rotation of the work string in the same direction as the hand of the work piece threaded connections without unscrewing said threaded connections between said running tool and the conduit gripping tool.

6. The running and setting tool of claim 4 or 5 further comprising a downwardly facing external shoulder on said tubular body portion engagable with an upwardly facing surface on said externally threaded sleeve for transmitting downward force to the body portion of the conduit gripping tool.

7. The running and setting tool of claim 4 wherein said means for securing said externally threaded sleeve for co-rotation with said tubular body comprises at least one axially extending external flat on said tubular body portion and an internal, axially extending flat in the bore of said externally threaded sleeve co-operating therewith.

8. A conduit gripping tool for setting in a subterranean well by a running tool connected to a tubular work string comprising: a tubular body; threaded means on the upper end of said tubular body for connection to a running tool; said threaded means being of opposite hand to the threaded connections of said tubular work string; annular segment slip means mounted on the exterior of said tubular body; pin and slot means connecting said slip means to said tubular body for co-movement during insertion of the tubular body in the well by the tubular work string; said pin and slot means being disengaged by rotation of said tubular body in the same direction as the hand of the work string threaded connections; means connected to said slip means for frictionally engaging the conduit wall to permit rotation of said tubular body relative to said slip means by rotation of the work string; means in the bore of said tubular body selectively engagable by axial shifting of the running tool for transmitting torque to said tubular body in the same direction as the hand of the tubular work string threaded connections; and an annular camming cone surrounding said tubular body and downwardly movable with said tubular body to cam said segmented slip means outwardly into gripping engagement with the conduit wall.

9. The conduit gripping tool of claim 8 wherein said means connected to said slip means comprises at least one outwardly bowed leaf spring.

10. The conduit gripping tool of claim 8 wherein each annular segment of said slip means is connected by a leaf spring to a first ring surrounding said tubular body portion; a second ring surrounding said tubular body portion and axially spaced from said first ring; and said means connected to said slip means comprises a plurality of peripherally spaced, outwardly bowed leaf springs connecting said first and second rings.

11. The conduit gripping tool of claim 8 wherein said pin and slot means comprises a radially projecting pin on said tubular body portion, and a ring freely surrounding said tubular body portion and attached to said slip means, said ring defining a slot receiving said pin.

12. The conduit gripping tool of claim 11 wherein said means connected to said slip means for frictionally engaging the conduit wall comprises a plurality of peripherally spaced, outwardly bowed leaf springs interconnecting said ring and said annular segment slip means.

13. The conduit gripping tool of claim 8, 9, 10, 11 or 12 further comprising an annular elastomeric seal surrounding said tubular body portion, and means responsive to downward setting movement of said tubular body portion relative to said slip means for compressing said annular elastomeric seal outwardly into sealing engagement with the conduit.

14. The conduit gripping tool of claim 8, 9, 10, 11 or 12 further comprising wicker threads on the exterior of said tubular body portion, and a locking sleeve having internal threads cooperating with said wicker threads to permit only downward relative movement of said tubular body portion, said sleeve abutting the upper end of said annular camming cone, thereby locking said tubular body portion and said slip means in the conduit gripping position.

15. The conduit gripping tool of claims 8, 9, 10, 11 or 12 further comprising an annular elastomeric seal surrounding said tubular body portion; means responsive to downward setting movement of said tubular body portion relative to said slip means for compressing said annular elastomeric seal outwardly into sealing engagement with the conduit; wicker threads on the exterior of said tubular body portion; and a locking sleeve having internal threads co-operating with said wicker threads to permit only downward relative movement of said tubular body portion; said sleeve abutting the upper end of said annular camming cone, thereby locking said tubular body portion in the conduit gripping and sealing position.

16. A well completion apparatus, comprising: a running tool and a conduit gripping tool; said running tool comprising a first tubular body, means on the upper end of said first tubular body for rigid connection to the end of a threadably connected work string, an externally threaded sleeve slidably mounted on said first tubular body for limited axial movement, said external threads being of opposite hand to the work string threaded connections, means for securing said externally threaded sleeve for co-rotation with said first tubular body, and at least one radially projecting, outwardly spring biased dog mounted in said tubular body immediate said externally threaded sleeve; said conduit gripping tool comprising a second tubular body surrounding said first tubular body, internal threads in the upper end of said second tubular body for connection to said external threads on said sleeve, annular segment slip means mounted on the exterior of said second tubular body, pin and slot means connecting said slip means to said second tubular body for co-movement during the insertion of the conduit gripping tool in the well by said running tool, said pin and slot means being disengagable by rotation of said second tubular body in the same direction as the hand of the work string threaded connections, means in the bore of said second tubular body selectively engagable by said radially projecting dog by axial shifting of the running tool relative to said casing gripping tool, thereby transmitting torque to said second tubular body in the same direction as the hand of the tubular work string threaded connections, spring biased means carried by said slip means for frictionally engaging the conduit wall to permit relative rotation of said second tubular body and said slip means by rotation of the running tool, and an annular camming cone surrounding said second tubular body and axially downwardly movable with said second tubular body to cam said annular segmented slip means outwardly into gripping engagement with the casing well.

17. The well completion apparatus of claim 16 further comprising a downwardly facing shoulder on said first tubular body portion engagable with an upwardly facing shoulder on said externally threaded sleeve for transmitting downward force to said second tubular body.

18. The well completion apparatus of claim 16 wherein said means for securing said externally threaded sleeve for corotation with said first tubular body comprises at least one axially extending external flat on said first tubular body portion and an internal flat in the bore of said externally threaded sleeve cooperating therewith.

19. The well completion apparatus of claim 16, 17 or 18 wherein said spring biased means carried by said slip means comprises a plurality of peripherally spaced, outwardly bowed leaf springs secured at one end to said slip means and at the other end to a ring containing the slot of said pin and slot means.

20. The well completion apparatus of claim 16, 17 or 18 wherein each angular segment of said slip means is connected by a leaf spring to a first ring surrounding said second tubular body portion, a second ring surrounding said second tubular body portion and axially spaced from said first ring, and said spring biased means carried by said slip means comprises a plurality of peripherally spaced, outwardly bowed leaf springs connecting said first and second rings.

21. The well completion apparatus of claim 16, 17 or 18 wherein said pin and slot means comprises a radially projecting pin on said second tubular body portion, a ring freely surrounding said second tubular body portion and defining a slot receiving said pin, said ring being connected to said spring biased means.

22. The well completion apparatus of claim 16, 17 or 18 wherein said pin and slot means comprises a radially projecting pin on said second tubular body portion, a ring freely surrounding said tubular body portion and defining a slot receiving said pin, and said spring biased means carried by said slip means comprises a plurality of peripherally spaced, outwardly bowed leaf springs connecting said ring to said slip means.

* * * * *